United States Patent [19]

Bates

[11] 4,409,486

[45] Oct. 11, 1983

[54] DEFLECTION SYSTEM FOR CHARGED-PARTICLE BEAM

[75] Inventor: Terence Bates, Horsham, England

[73] Assignee: U.S. Philips Corporation, New York, N.Y.

[21] Appl. No.: 268,457

[22] Filed: May 29, 1981

[30] Foreign Application Priority Data

Jun. 10, 1980 [GB] United Kingdom ..... 8018987
Apr. 15, 1981 [GB] United Kingdom ..... 8111893

[51] Int. Cl.[3] ..... H01J 3/12
[52] U.S. Cl. ..... 250/396 ML
[58] Field of Search ..... 250/396 R, 396 ML, 397, 250/398, 493.1; 313/361.1

[56] References Cited

U.S. PATENT DOCUMENTS 4,056,728 11/1977 LeBoutet ..... 250/396 R
4,191,887 3/1980 Brown ..... 250/396 ML

FOREIGN PATENT DOCUMENTS 2076690 10/1971 France ..... 313/361.1
1269017 3/1972 United Kingdom .
1413741 11/1975 United Kingdom .

*Primary Examiner*—Alfred E. Smith
*Assistant Examiner*—Carolyn E. Fields
*Attorney, Agent, or Firm*—Jack E. Haken

[57] ABSTRACT

A system for achromatically deflecting a beam of charged particles without producing net divergence of the beam comprises three successive magnetic deflection means (A,B,C) which deflect the beam alternately in opposite directions, the first (A) and second (B) by angles of less than 50° and the third (C) by an angle of at least 90°; particles with different respective energies are transversely spaced as they enter the third deflection means (C), but emerge completely superimposed in both position and direction, and may be brought to a focus (F) in each of two mutually perpendicular planes a short distance thereafter. Such a system may be particularly compact, especially in the direction in which the beam leaves the system, and is suitable for deflecting a beam of electrons from a linear accelerator (5,6,7) so as to produce a vertical beam of electrons (or with an X-ray target, of X-rays) which can be rotated about a horizontal patient for radiation therapy.

17 Claims, 3 Drawing Figures

DEFLECTION SYSTEM FOR CHARGED-PARTICLE BEAM

This invention relates to a system for deflecting a beam of charged particles and has particular but not exclusive reference to a system for deflecting a beam of electrons produced by a linear accelerator (hereinafter referred to as a linac) such as is used, for example, for medical purposes.

More specifically, the invention relates to an achromatic system for deflecting a beam of charged particles comprising a plurality of spaced successive magnetic deflection means arranged to produce in operation successive deflections of the beam in alternate directions, the system causing substantially no net divergence, in each of two mutually perpendicular planes, of the beam leaving the system compared with the beam entering the system.

In this specification and the appended claims, a beam deflection system is considered to be achromatic if it produces substantially no net energy dispersion with regard to both the position and the direction of motion of charged particles which emerge from the system. Thus, if a parallel beam of charged particles with a spread of energies enters the system, the paths of particles with different energies which leave the system must be superimposed, with respect to both position and direction.

It is usual practice in medical linac systems to have the accelerating waveguide extending in an approximately horizontal direction and then to deflect the emergent electron beam magnetically into a vertical plane (although some low-energy, that is to say about 6 MeV or less, systems using very short accelerator waveguides can be mounted vertically thus obviating the need for a magnetic deflection system), the patient being positioned horizontally. When used as an X-ray system the beam then impinges upon a target and generates an X-ray beam; alternatively, the electron beam itself may be used for treatment, with the X-ray beam-generating components moved out of the way. The electron-beam deflection system and the X-ray target are housed in a head assembly adjacent the end of the accelerating waveguide, the majority of the space within the head being required for X-ray production, field flattening, field definition and monitoring.

In order to be able to vary the angle at which the beam of electrons or X-rays is incident on the patient, the accelerating waveguide and head assembly may be required to rotate about a horizontal axis on or close to which the patient is positioned and to pass underneath the patient. An important parameter is therefore the height of the head assembly and hence of the deflection system, i.e. their radial extent with respect to the axis of rotation.

Irrespective of whether the electron beam is itself used for treatment or impinges on a target to generate an X-ray beam (in which case there is a marked peak in the intensity of X-radiation in the direction of motion of the electrons incident on the target), it is desirable that the electron beam emerging from the deflection system should be accurately predetermined in both position and direction and should have a small cross-sectional area. However, the beam of electrons produced by the linac shows both an instantaneous range of energies (from which it is usual to select electrons having an energy within say ±5% of a mean energy) and a fluctuation with time in the mean energy.

The most compact choice of magnetic deflection system, a simple dipole magnet with a deflection angle of about 90° and a trajectory height of one bending radius (which is about 5 cm for 20 MeV electrons) has the drawback that the magnet produces energy dispersion, both positional and directional, of the emergent electron beam: this has had an adverse effect on the quality of the electron or X-ray beam used for treatment, for example the field flatness and penumbra of the X-ray field. For this reason more complex magnet systems which are less dispersive or which are substantially achromatic have been developed; in some cases the systems are also spatially focusing, providing a small amount of net convergence to compensate for slight divergence of the beam emerging from the linac and/or to reduce the beam diameter.

One such more complex system uses 45° dipole lenses with an intermediate quadrupole lens, but the most popular is some form or other of the well-known 270° system which however has a height of about three bending radii. Thus, whilst a 270° system is a reasonable choice for low and medium energy machines, the height of the deflection system becomes unacceptable for energies in the region of 20 MeV and above. These and other general types of system are described in "Focusing of Charged Particles" Volume II (Academic Press 1967), see Chapter 4, 2 "Deflecting Magnets" by Harald A. Enge.

An object of the invention is to provide an achromatic system which can bend a beam through 90° or more without producing net divergence of the beam (being for example spatially focusing) but which may be compact, at least as regards its extent in the direction in which the beam leaves the system.

According to the invention, a system as set forth in the second paragraph of this specification is characterised in that said plurality comprises in succession first and second magnetic deflection means each for deflecting the beam through an angle not substantially greater than 50 degrees followed by third magnetic deflection means for deflecting the beam through an angle not substantially less than 90 degrees, and wherein in operation charged particles with different respective energies entering the third deflection means are transversely spaced.

Suitably, in operation said particles with different respective energies pass through transversely spaced respective foci between the first and third deflection means. This enables said particles of different respective energies to be brought to a common focus a short distance after the third deflection means. Preferably, in operation the paths after the second deflection means of said particles with different respective energies are convergent. The design of the third deflection means may thereby be simplified.

Suitably, at least one of the group of four faces which consists of the entrance and exit faces of the first and second deflection means is inclined relative to a plane which is normal to the beam at the respective point of entry or exit; at least one of said faces of both the first and second deflection means may be so inclined. This assists in obtaining achromatic deflection through a large angle.

The angles through which the beam is deflected in operation by the first and second deflection means respectively may be substantially equal. This can assist in obtaining a system of small height.

Two successive magnets may form a pair in which each acts as a return yoke for the other.

An embodiment of the invention will now be described by way of example with reference to the diagrammatic drawings in which.

Figure 1:
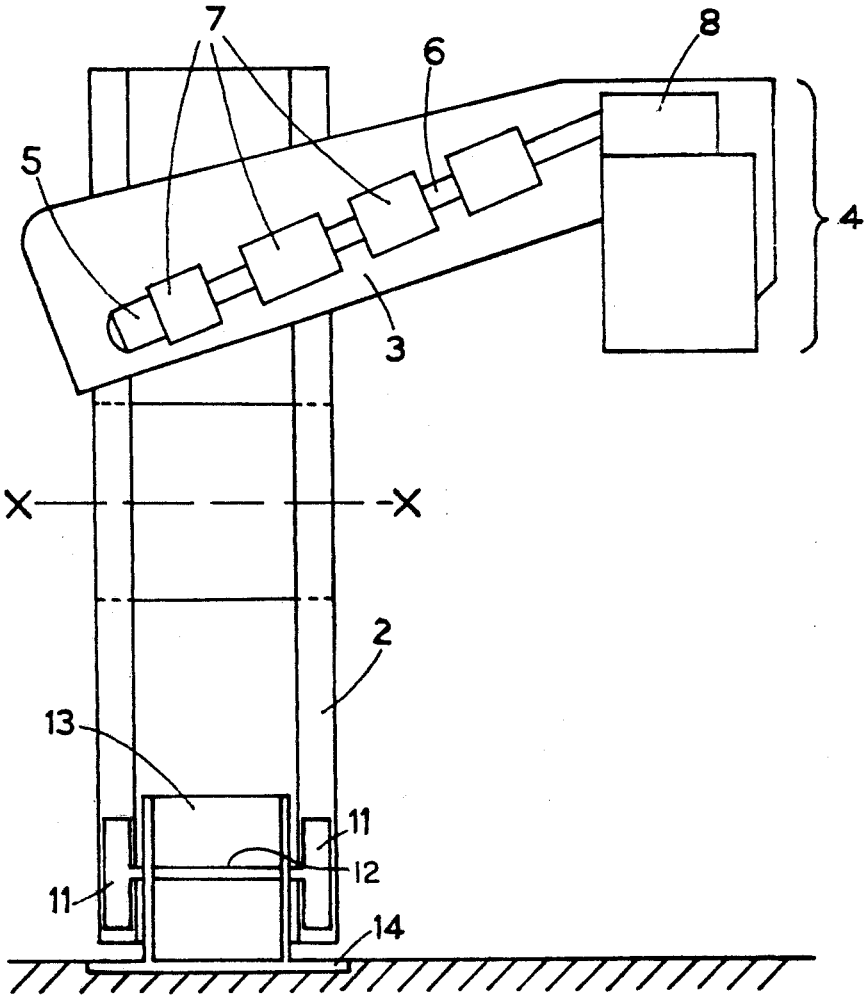
FIG. 1 is a schematic side view of a linear accelerator assembly provided with a beam deflection system embodying the invention.

Referring to FIG. 1 a rotatable linac assembly comprises an annular support member 2 carrying a cantilever arm 3: at its end remote from the annular member 2, the arm carries an X-ray head assembly 4. Within the arm is supported, by means not shown, a linear electron accelerator comprising an electron gun 5 and an accelerating waveguide 6; beam-centering and focusing coils 7 are disposed around the waveguide which delivers a beam of electrons to a magnetic beam-deflecting system 8 forming part of the head assembly 4. The electron beam emerges from the waveguide 6 upwardly inclined at an angle of, for example, 22½ degrees and is deflected by the system 8 into a vertically downward direction. The electron beam may generate an X-ray beam within the head 4 so that either the electron beam or the X-ray beam emerges from the under face of the head 4. In the manner described in U.K. Patent Specification No. 1,036,348, the annular member 2 is supported on and between two pairs of rollers 11 which are mounted on spaced respective axles 12 (only one pair of rollers 11 and its respective axle 12 appear in FIG. 1); the rollers engage edge portions of the member 2 so that the latter is rotatable through 360° about a horizontal axis X—X, the axles 12 being journalled in respective brackets 13 attached to a base member 14 embedded in the ground. FIG. 1 depicts the assembly with the arm 3 in its rotationally uppermost position.

Figure 2:
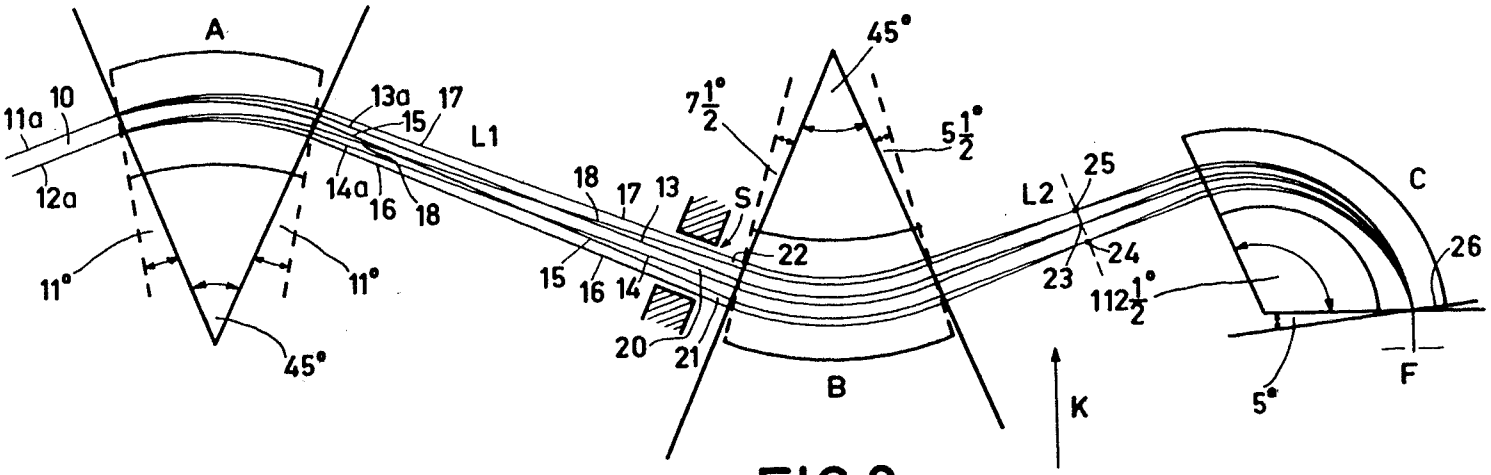
FIG. 2 represents the paths of electrons in a vertical plane.

FIG. 2 illustrates in a vertical plane the paths of electrons through the deflection system 8 which comprises three spaced successive magnetic deflection means A, B and C respectively each consisting of a single magnet, only one pole face of each of the three magnets being shown. Electrons from the linac enter the system (at the left, as drawn) in the form of a parallel beam 10 with a radius of 3 mm and an average energy of 25 MeV. The three magnets produce successive deflections of the beam in alternate directions, magnets A and B deflecting the beam through small and in this case equal angles and magnet C deflecting the beam through a large angle, there being free flight spaces L1, L2 between the magnets.

The Figure shows the paths of electrons which enter the system along vertically opposed edges of the beam 11*a* and 12*a* the subsequent paths being depicted for average energy electrons 13*a* and 14, for electrons having energy 5% less than average 15 and 16 and for electrons having energy 5% greater than average 17 and 18. The effect of the magnet A is to deflect the average energy electrons through an angle of 45 degrees, whilst higher and lower energy electrons are deflected through somewhat smaller and larger angles respectively, giving rise to energy dispersion (divergence) in the vicinity of the second magnet.

The second magnet B then deflects the beam in the opposite direction, the deflection angle also being 45 degrees for average energy electrons, and at the same time produces energy convergence, i.e. electrons with different respective energies are convergent as they leave magnet B.

Finally magnet C then causes the various energy components to converge further, the angle of deflection of the average energy electrons being 112½°, so that they emerge completely superimposed in both position and direction; the beam as a whole is also brought to a spatial focus F, in both a substantially vertical plane and a substantially horizontal plane a short distance beyond the exit pole face of magnet C.

Figure 3:
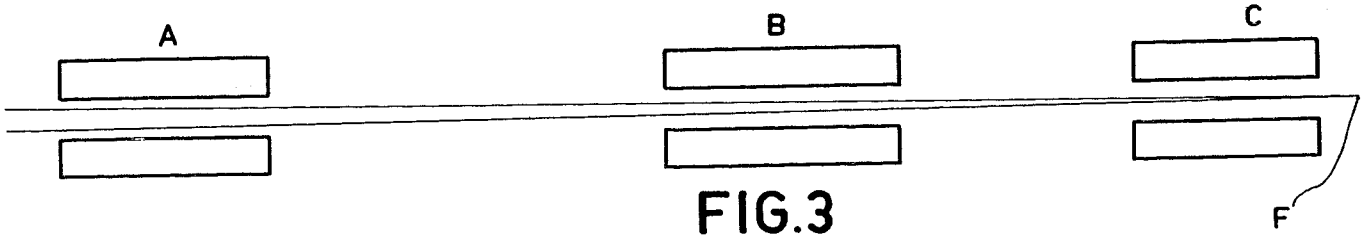
FIG. 3 represents the paths of electrons in a horizontal plane.

FIG. 3 represents the system as seen from below, looking in the direction of the arrow K shown in FIG. 2, and illustrates how as the beam travels through the system it is focused in a substantially horizontal plane.

It will be seen that although electrons with different respective energies are convergent as they leave magnet B, they are still transversely spaced as they enter magnet C; this is necessary in order that these electrons may have both a common position and a common direction as they leave magnet C. In addition, these electrons with different respective energies pass through transversely-spaced respective focui (point 23 for average energy electrons, point 24 for below-average energy electrons, and point 25 for above-average electrons) between magnets A and C, in this case B and C, (the energy convergence may be readily seen at these foci) so that electrons with the same respective energies are divergent as they enter magnet C; this enables the beam to be brought to a spatial focus in a vertical plane beyond the exit of magnet C.

Suitably, at least one of the entrance or exit pole faces of magnets A and B, i.e. one of the group of four faces which consists of the entrance and exit faces of magnets A and B, is inclined from normal entry or exit, that is to say is inclined relative to a plane which is at right angles to the direction of the beam at that pole face. This assists the production by the system of achromatic deflection through a large angle. Preferably, at least one face of each of magnets A and B is so inclined: this also assists in obtaining focusing in both a vertical and a horizontal plane.

As indicated in the Figure, in this embodiment the entrance and exit faces of magnet A are each inclined at an angle of 11 degrees with respect to normal entry and exit, and the angles of inclination of entrance and exit faces of magnet B are 7½ degrees and 5½ degrees respectively. The entry pole face of magnet C is not inclined but its exit face has an inclination of 5 degrees to normal exit. The combined effect of these pole face inclinations is that the system produces achromatic deflection for electrons with energies within about 10% of the average particle energy, with the beam additionally being brought to a common spatial focus in both the plane of bending and a plane at right angles to the bending plane.

Focusing provided by the deflection system may simplify or eliminate requirements for focusing in the linac itself.

As the beam has a good energy resolution in the vicinity of the second magnet B, an energy-defining slit S may be placed in this region. A slit placed just after B give the best energy selection because of the transversely-spaced foci there for different energies, but stray X-radiation produced by a slit in such a position would tend to be directed slightly upwards (in the same direction as the electron beam travelling from B to C), which would generally necessitate additional shielding above magnet C and would thereby increase the height of the head assembly. Placing a slit just before B still provides reasonable energy selection and has the advantage of directing stray X-radiation slightly downwards where it is more easily shielded, particularly by the X-ray shielding material already present in the head below magnet C; this location is illustrated in FIG. 2.

In the embodiment illustrated, the flux densities in the pole gaps of magnets A and B are both 8.5 kilogauss and the pole gaps are 12 mm: since these magnets have opposite polarities and the same flux densities and pole gaps, one magnet can serve as the return yoke for the other, thus providing a weight saving on magnetic material. The flux density in the gap of magnet C is 17 kilogauss and the pole gap is 8 mm. It will be understood that the principle of making one magnet serve as the return yoke for the other, referred to by Enge in the above-cited reference, is applicable to any pair of preferably adjacent magnets although it is more conventient to use it with magnets having the same flux density. Thus for example it would be possible to form magnets B and C as a pair with a suitable shunt across the gap of magnet B so as to achieve in that gap a lower flux density than that in the gap of magnet C.

The free flight spaces L1 and L2 are 124 mm and 74 mm respectively. The focus F is about 3 cm beyond the exit of magnet C.

The lengths of the free flight spaces generally decrease as the angles of deflection of the first and second deflection means increase. If these angles are substantially greater than 50°, the distances between the deflection means necessary for the system to be achromatic may be unrealisably small (the distances may be theroretically negative); if the angles are very small, for example less the 10°, the extent of the system in a direction roughly perpendicular to the finally emergent beam may be undesirably great.

It may be seen that if the angles of deflection of the first and second deflection means are approximately equal, the contributions of these deflection means to the extent of the system in the direction of the finally emergent beam may thereby be minimised.

For the third deflection means, the angle of deflection must be not substantially less than 90° in order that the transversely-spaced electrons with different respective energies at its entrance may be completely superimposed in position and direction at its exit, while the maximum angle of deflection will be related to the net deflection required from the system; when used with a linac, the latter angle is unlikely to exceed 130°.

In the embodiment described with reference to FIGS. 2 and 3, the sum of the deflection angles (without regard to the direction of deflection) is $45°+45°+112\frac{1}{2}°=202\frac{1}{2}°$, and consequently there is a significant reduction in the weight of and space occupied by the magnetic material and (where, as usual, the magnets are electromagnets) of the associated coils, compared with a 270° system.

A magnetic deflection means may comprise more than one magnet: it may for example comprise two spaced successive magnets.

A deflection system embodying the invention may find application other than with linacs; it may for example be applicable to mass spectrographs and ion-implantation devices.

I claim:

1. An achromatic system for deflecting a beam of charged particles comprising a plurality of spaced successive magnetic deflection means arranged to produce in operation successive deflections of the beam in alternate directions, the system causing substantially no net divergence in position and direction, in each of two mutually perpendicular planes, of the beam leaving the system compared with the beam entering the system, characterised in that said plurality comprises, in succession, first and second magnetic deflection means each for deflecting the beam through an angle not substantially greater than 50 degrees followed by a third magnetic deflection means for deflecting the beam through an angle not substantially less than 90 degrees, and wherein in operation charged particles with different respective energies entering the third deflection means are transversely spaced.

2. A system as claimed in claim 1 wherein in operation said particles with different respective energies pass through transveresely spaced respective foci between the first and third deflection means.

3. A system as claimed in claim 1 wherein, in operation, the paths of said particles with different energies are convergent after the second deflection means.

4. A system as claimed in any preceding claim wherein at least one of the group of four faces which consists of the entrance and exit faces of each of the first and second deflection means is inclined relative to a plane which is normal to the beam at the respective point of entry or exit.

5. A system as claimed in claim 4 wherein at least one of said faces of both the first and second deflection means are so inclined.

6. A system as claimed in claim 4 wherein the respective angles through which the beam is deflected by the first and second deflection means are substantially equal.

7. A system as claimed in claim 4 having a common focus for the beam in each of two mutually perpendicular planes following the third deflection means.

8. A system as claimed in claim 4 wherein two successive magnetic deflection means form a pair in which each magnetic deflection means acts as a return yoke for the other.

9. A system as claimed in claim 8 wherein said pair comprises the first and second deflection means.

10. A system as claimed in claim 2 wherein, in operation, the paths of said particles with different energies are convergent after the second deflection means.

11. The system as claimed in claim 1 wherein the respective angles through which the beam is deflected by the first and second deflection means are substantially equal.

12. A system as claimed in claim 1 having a common focus for the beam, in each of two mutually perpendicular planes, following the third deflection means.

13. The system as claimed in claim 1 wherein two successive magnetic deflection means form a pair wherein each magnetic deflection means acts as a return yoke for the other.

14. A linear accelerator in combination with an achromatic system for deflecting a beam of charged particles, said achromatic system comprising a plurality of spaced successive magnetic deflection means arranged to produce in operation successive deflections of the beam in alternate directions, the system causing substantially no net divergence in position and direction, in each of two mutually perpendicular planes, of the beam leaving the system compared with the beam entering the system, characterised in that said plurality comprises, in succession, first and second magnetic deflection means each for deflecting the beam through an angle not substantially greater than 50 degrees followed by a third magnetic deflection means for deflecting the beam through an angle not substantially less than 90 degrees, and wherein in operation charged particles with different respective energies entering the third deflection means are transversely spaced.

15. A combination as claimed in claim 14 wherein, in operation, said particles with different respective energies pass through transversely spaced respective foci between the first and third deflection means and wherein at least one group of the four faces which consist of the entrance and exit faces of each of the first and second deflection means is inclined relative to a plane which is normal to the beam at the respective point of entry or exit.

16. A combination as claimed in claim 14 wherein, in operation, the paths of said particles with different energies are convergent after the second deflection means and wherein at least one of the group of four faces which consist of the entrance and exit faces of each of the first and second deflection means is inclined relative to a plane which is normal to the beam at the respective point of entry or exit.

17. A combination as claimed in claim 14 where at least one of the group of four faces which consists of the entrance and exit faces of each of the first and second deflection means is inclined relative to a plane which is normal to the beam at the respective point of entry or exit.

* * * * *